United States Patent [19]

Epstein

[11] 4,034,992

[45] July 12, 1977

[54] RELEASABLE HOOK

[75] Inventor: Irving Epstein, Mercer Island, Wash.

[73] Assignee: Washington Chain & Supply, Inc., Seattle, Wash.

[21] Appl. No.: 596,920

[22] Filed: July 17, 1975

[51] Int. Cl.[2] ..... B66C 1/38

[52] U.S. Cl. ..... 294/83 R; 294/84

[58] Field of Search ..... 294/84, 83 R, 83 A, 294/82 R, 83 AB, 88, 75, 103, 104, 66; 114/238; 24/241 R, 241 P, 241 PA, 241 SB

[56] References Cited

U.S. PATENT DOCUMENTS

| | | | |
|---|---|---|---|
| 2,714,731 | 8/1955 | Binmore | 296/84 |
| 2,903,292 | 9/1959 | Himel, Jr. | 294/75 |
| 3,762,757 | 10/1973 | Epstein | 294/84 |
| 3,811,720 | 5/1974 | Epstein | 296/84 |
| 3,926,467 | 12/1975 | Crissy et al. | 294/83 R |

FOREIGN PATENT DOCUMENTS

| | | | |
|---|---|---|---|
| 560,447 | 4/1944 | United Kingdom | 294/84 |

*Primary Examiner*—James B. Marbert
*Attorney, Agent, or Firm*—Thomas W. Secrest

[57] ABSTRACT

In the mooring of ships and boats to a dock, it is necessary to have a line run from the ship or boat to the dock. The line can be more or less tight and must be fixed so as to allow relatively little movement of the ship or boat with respect to the dock. Then, when it is necessary to allow the ship or boat to sail away from the dock, it is necessary to disengage the line from the fastening means on the dock. This invention relates to a fastening means whereby a line can be positioned to the fastening means for securing the ship or boat adjacent to the dock. Then, the person on the dock can mechanically actuate the fastening means to allow the line to slip away from the fastening means and also to allow the ship or boat to sail away from the dock. This fastening means is identified as a releasable hook. When it is desired to have the ship or boat fixedly secured with respect to the dock, the fastening means is in a locked position to firmly position the line. Then, when it is desired to allow the line to be slipped and to allow the ship or boat to sail away from the dock, the operator on the dock can quickly and easily disengage the fastening means, or releasable hook, from the line.

19 Claims, 9 Drawing Figures

RELEASABLE HOOK

THE BACKGROUND OF THE INVENTION

Ships and boats are tied to a dock by a line. The ships and boats must be, securely, tied to the dock until it is time to be released from the dock. Then, the line can be released from the ship or from the dock and the ship and boat allowed to move away from the dock.

Normally, the line is attached to the ship or boat and runs to the dock. On the dock there is a releasable hook. The releasable hook is of such construction as to be able to withstand the pulling on the line by the boat. Due to the action of the water, the boat is moved with respect to the dock and the line running from the boat or ship to the dock must be sufficiently strong so as not to break with this movement of the boat or ship and also the releasable hook must be of such construction as to not break or release the line upon the pulling of the line by the ship or boat.

The releasable hook on the dock has two main functions. One of these functions is to firmly position the line running from the ship and boat so that the line will not move away from the releasable hook and therefore the ship or boat will not move away from the releasable hook and the dock. A second function of the releasable hook is to, positively, release the line when the releasable hook is tripped so that the ship or boat can move away from the dock.

THE GENERAL DESCRIPTION OF THE INVENTION

This invention is a rotatable, releasable hook having a positive locking mechanism to prevent the rotatable, releasable hook from rotating, accidentally. There must be a positive actuating means to unlock the locking mechanism so that the rotatable, releasable hook can rotate. Also, in addition to the positive locking mechanism of this releasable hook, there is a positive release mechanism to allow the rotatable, releasable hook to rotate and to release a line running to a ship or a boat so that the ship or boat can pull away from the dock.

The size of this releasable hook can vary. For example, this releasable hook can be made in a 50-ton size, 100-ton size, 150-ton size, or any reasonable size.

THE OBJECTS AND ADVANTAGES

An object of this invention is to provide a releasable hook which has a positive locking mechanism to prevent the rotation of the releasable hook, without positive actuation, and the release of the line held by the releasable hook; a further object of this invention is to provide such a releasable hook with the positive release mechanism to release the rotatable hook and thereby release the line so that a ship or boat can pull away from the dock; a further object and advantage of this invention is to provide such a releasable hook which is, relatively, free of maintenance; another important object and advantage of this invention is to provide such a releasable hook which is inexpensive to manufacture; another object of this invention is to provide such a releasable hook which is, relatively, free of moving parts; and, an additional object and advantage of this invention is to provide such a releasable hook which is easily operated and will quickly allow disengagement of the line from the ship or boat to the release hook.

These and other important objects advantages of the invention will be more particularly brought forth upon reference to the detailed description of the invention, the appended claims, and the accompanying drawings.

THE DRAWINGS

Figure 8:
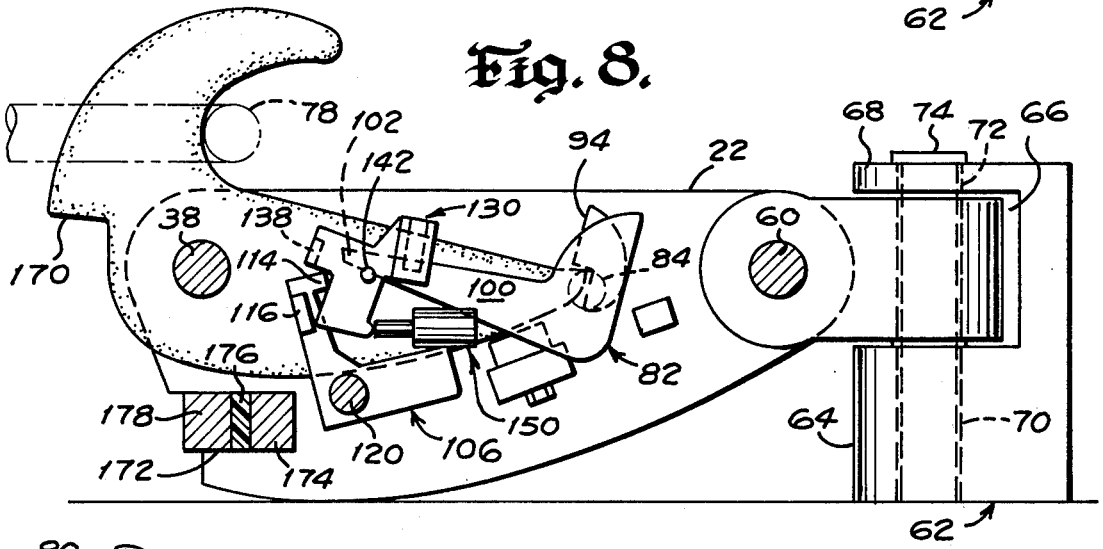
Figure 9:
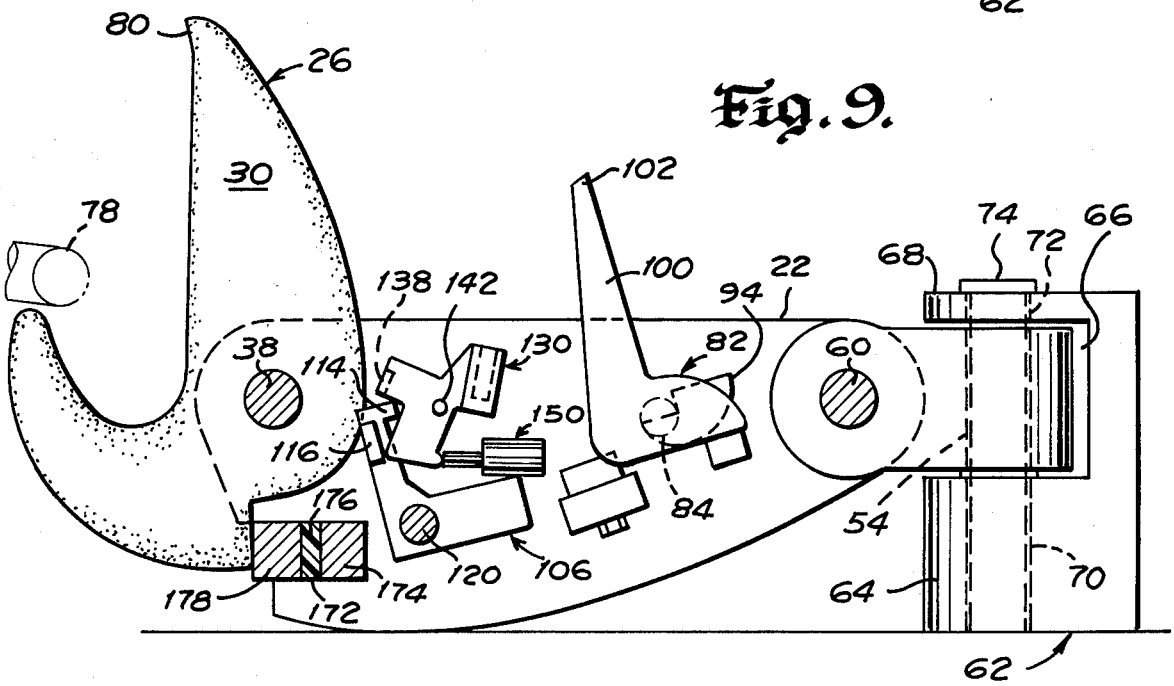

FIG. 8 is a fragmentary view illustrating the inner lock moved away from the locking arm so that the locking arm is free to move away from the locking pawl to allow movement of the locking pawl and in turn to allow rotation of the U-shaped hook; and, FIG. 9 is a fragmentary view illustrating the inner lock being moved away from the locking arm and the locking arm being moved away from the locking pawl so the locking pawl can rotate out of position to allow the U-shaped hook to rotate and, as is seen in FIG. 9, the U-shaped hook has rotated so as to allow release of the line.

THE DETAILED DESCRIPTION OF THE INVENTION

There is positioned between the sides 22 and 24 a U-shaped hook 26 having a hook portion 28 and a main body portion 30.

In the sides 22 and 24, are passageways 32 and 34. Also, in the U-shaped hook 26, there is a passageway 36.

A bolt 38 projects through the passageways 34, 36, and 32 so as to position the U-shaped hook 26 between the sides 22 and 24. It is understood that passageway 36 is of a larger internal diameter than the external diameter of the bolt 38 so that the U shaped hook 26 is free to rotate around the bolt 38. There is a nut 40 which screws onto the threaded end of the bolt 398. Further, between the U-shaped hook 26 and the side 24, there is a spacer or washer 42 so as to position the main body portion 30 of the U-shaped hook near the side 22. It is to be understood that the bolt 38 is positioned in a passageway in the spacer or washer 42.

Figure 1:
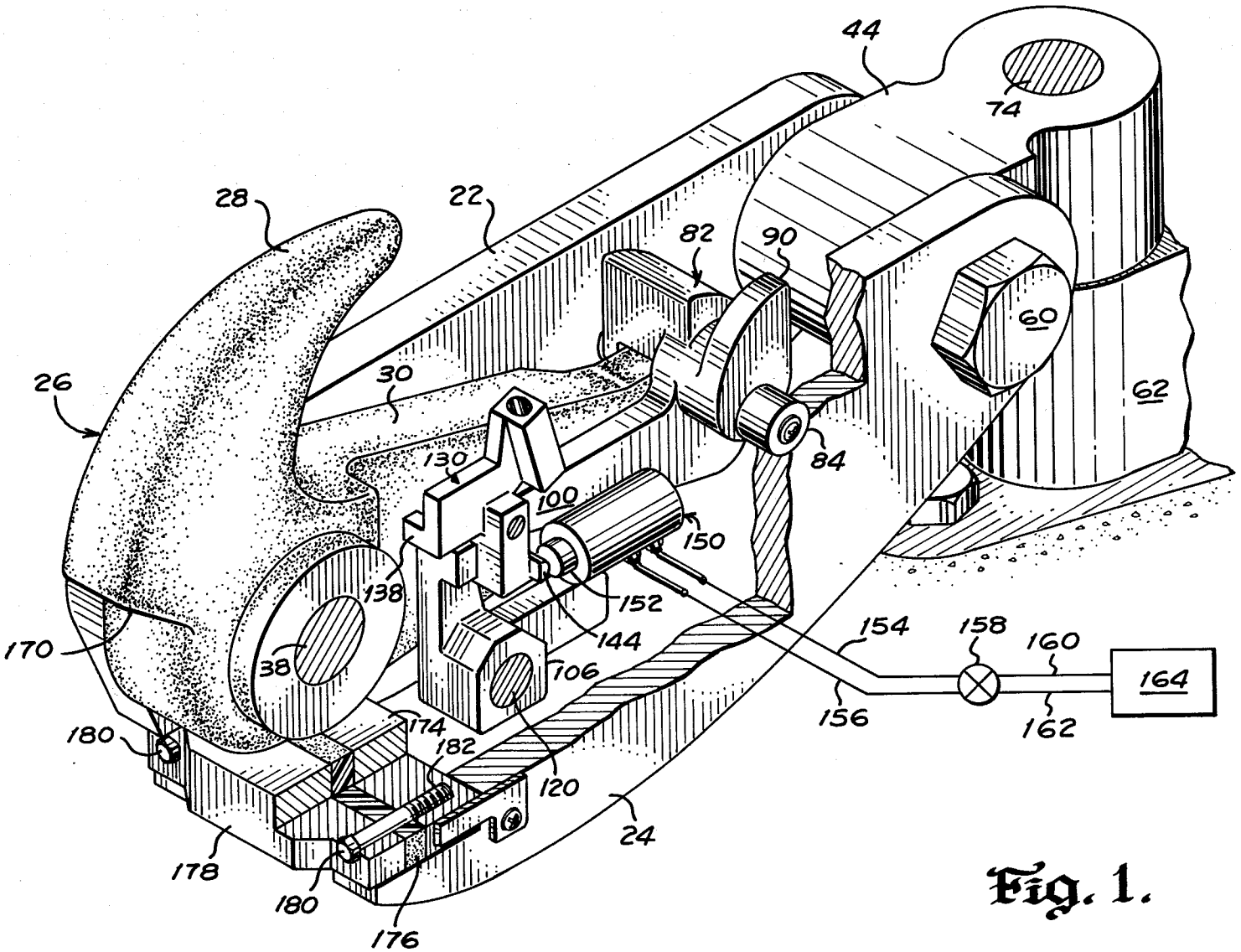
FIG. 1 is a fragmentary, axonometric view looking at the locking mechanism for locking the releasable hook in position and also looking at the release mechanism for releasing the releasable hook to rotate.
Figure 2:
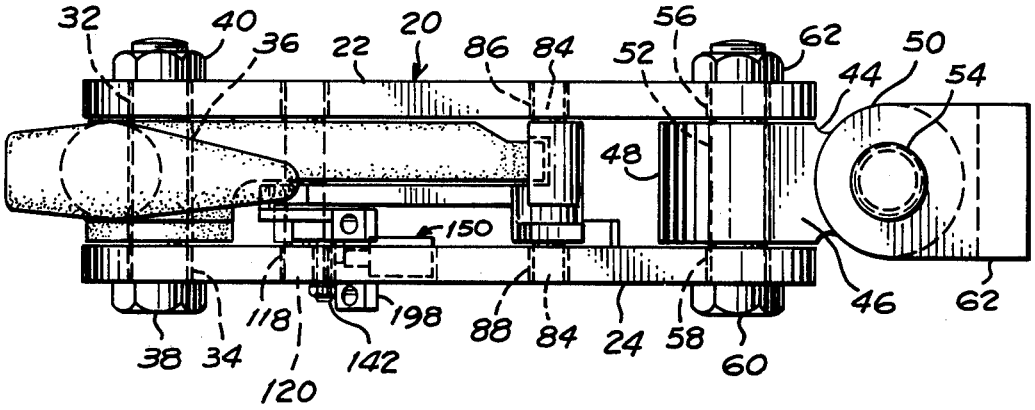
FIG. 2 is a plan view looking down on the releasable hook and the mechanism for locking the releasable hook in position and the mechanism for releasing the releasable hook to rotate.

In FIGS. 1 and 2, it is seen that the main body portion 30 of the U-shaped hook 26 is reduced in thickness so as to be able to accommodate the locking mechanism and the release mechanism positioned between the sides 22 and 24.

At the other end of the sides 22 and 24, there is a crosshead 44.

The crosshead 44 comprises a main body portion 46 having on one side a circular body 48 and on the other side a circular body 50. The circular body 48 has a through passageway 52. The circular body 50 has a through passageway 54.

It is to be noted that the longitudinal axis of the circular body 48 or the passageway 52 is at, substantially, right angles to the longitudinal axis of the circular body 50, or longitudinal passageway 54.

In the side 22, there is a passageway 56 and in the side 24, there is a passageway 58. A bolt 60 projects through the passageway 58 in the side 24, through the passageway 52 in the circular body 48 and through the passageway 56 in the side 22. A nut 62 is screwed onto the bolt 60.

Figure 7:
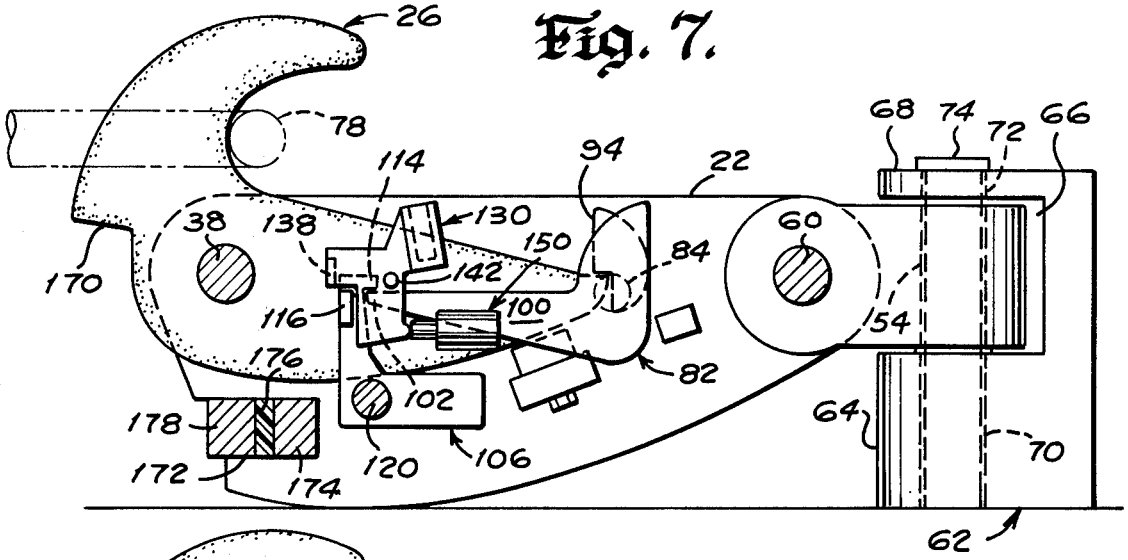
FIG. 7 is a fragmentary view illustrating the relationship of the inner lock, the locking arm, the locking pawl, and the U-shaped release hook with the inner lock locking the locking arm in position to restrict movement of the locking arm and thereby to restrict movement of the locking pawl and the U-shaped hook.

The circular body 50 connects with a mounting bracket 62. The mounting bracket comprises a body portion 64 having a recess 66. In FIGS. 7, 8, and 9, it appears that the recess 66 defines a U-shaped recess of which the body portion 64 is the lower part and there is an upper lip or ledge 68.

In the main body portion 64, there is a passageway 70 and in the lip or ledge 68, there is a passageway 72. A pin or keeper 74 projects through the passageway 72, the passageway 54 in the circular body 50, and into the passageway 70 in the main body portion 64. It is to be understood that the main passageway 54 in the circular body 50 is larger in diameter than the pin or keeper 74.

It is seen that the adapter or crosshead 44 can rotate in a horizontal pattern around the pin 74 in the mounting bracket 2. Also, it is seen that the releasable hook 20 can rotate in a vertical path or pattern around the bolt or pin 60. In other words, the release hook can rotate both horizontally and vertically, viz., substantially at right angles to each other, so as to have a wide degree of freedom in horizontal rotation and in vertical rotation and in the combination of horizontal rotation and vertical rotation.

In operation, the object is to lock the U-shaped hook 26 in position so as to firmly hold the line 78. There must be mechanism to positively position the U-shaped hook 26 and also there must be a mechanism to release the U-shaped hook 26 for rotation so that the line 78 can slip out of the hook portion 28 and be free.

In FIG. 9, it is seen that on the outer end of the main body portion 30, there is an upwardly or outwardly turned locking surface 80.

In FIGS. 1 and 7, it is seen that the U-shaped hook 26 is locked in position and is not free to rotate to release the line 78.

The locking mechanism comprises a locking pawl 82. The locking pawl 82 has a main shaft 84.

In the side 22, there is a passageway 86 and in the side 24, there is a passageway 88. The main shaft 84 is journaled in the passageways 86 and 88.

Figure 3:
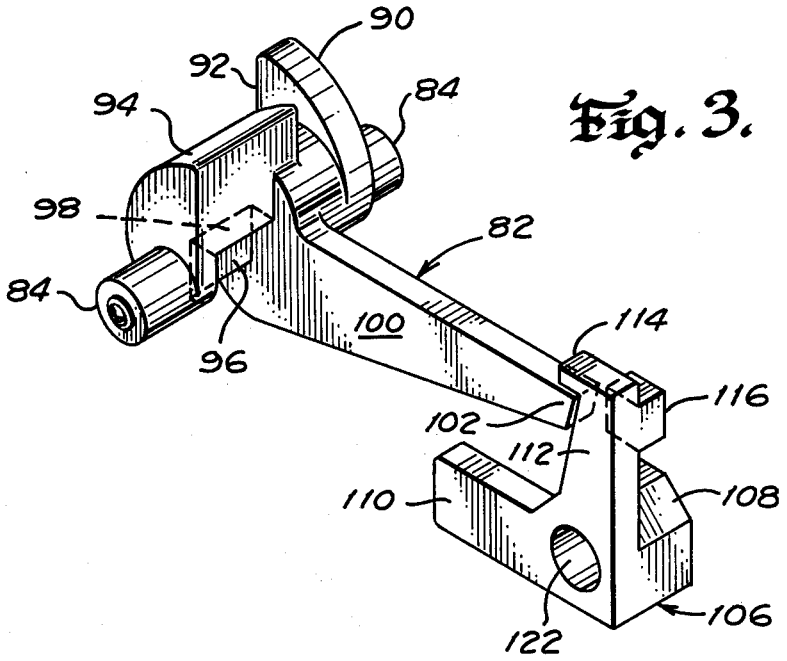
FIG. 3 is an axonometric view looking at the locking pawl and the locking arm and with the locking arm preventing the rotation of the locking pawl.

The locking pawl 82 has a stop cam 90 with a flat cam base 92 directed toward the crosshead or adapter 44. Also, the locking pawl 82 also has a locking bearing cam 94. In FIG. 3, it is seen that the underneath part of the locking bearing cam 94, and that part which is positioned near the main body of the locking pawl 82 is recessed at 96 into a depth or a cavity. Also, on the underneath part of the locking bearing cam 94, there is a flat surface or a locking bearing surface 98. In FIG. 1, also in FIG. 7, it is seen that the locking surface 80 of the U-shaped hook 26 bears against the locking bearing surface 98 so as to be firmly positioned by the locking bearing surface 98.

The locking pawl 82 has an arm 100 with a tip bearing surface 102.

The locking pawl 82 can be prevented from rotating by means of a locking arm 106. The locking arm 106 has a hub portion 108 and an arm 110 directed toward the shaft 84 of the locking pawl 82. Also, the locking arm 106 has an upwardly directed arm 112 from the hub portion 108. On the end of the upwardly directed arm 112, there is a locking edge 114 which is directed toward the shaft 84 of the locking pawl 82 or directed in the direction of the locking bearing cam 94 and the stop cam 90.

Near the upper end of the upwardly directed arm 112 there is a pawl lug 116. The pawl lug 116 is on that side of the upwardly directed arm 112 as is the hub 108.

In the side 24, there is a passageway 118. There is journaled in the passageway 118 in the side 24, a shaft 120. In the hub 108 of the locking arm 106, there is a passageway 122. The shaft 120 is positioned in the passageway 122.

Figure 5:
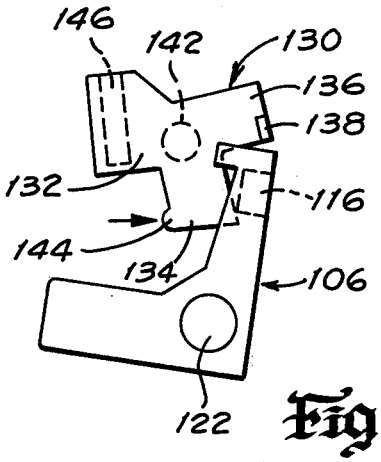
FIG. 5 is a side, elevational view illustrating the inner lock and the locking arm with the inner lock moved out of restricting position with respect to the locking arm so as to allow the locking arm to move and thereby allow the locking pawl to move and thereby allow the release hook to rotate to release a line.

The locking arm 106 and the shaft 120 are free to rotate with respect to the journaling of the shaft 120 in the passageway 118. In FIG. 5, also in FIGS. 5 and 8, there is illustrated the rotation of the locking arm 106.

In FIG. 3, it is seen that the locking end 102 of the locking pawl is fixed into position by means of the locking ledge 114 of the locking arm 106. In other words, the locking pawl 82 is locked into position and is not free to rotate so as to allow the U-shaped hook 26 to rotate to release the line 78.

There is an inner lock 130. The inner lock 130 comprises a main body portion 132 with a downwardly directed leg 134 and a rearwardly directed leg 136. On the lower, outer end of the rearwardly directed leg 136, there is a locking lug 138. As is seen in FIG. 1, the locking lug 138 is positioned between the upper end of the leg 112 of the locking arm 106 and the bolt 38 for the U-shaped hook 26. The locking lug 138 prevents the rotation of the locking arm 106. More particularly, with reference to FIG. 4, it is seen that the locking lug 138 prevents the clockwise rotation of the locking arm 106. This means that the locking pawl 82 is fixed in position as the locking end 102 of the locking pawl 82 is prevented to rotate because of the locking ledge 114 of the locking arm 106.

More particularly, there is a pin 142 in the side 24 and which pin 142 is also in the main body of the inner lock 130. As is seen in FIGS. 4 and 5, the inner lock 130 is free to rotate.

On the lower part of the downwardly directed leg 134, there is a bearing member or bearing ledge 144.

Figure 4:
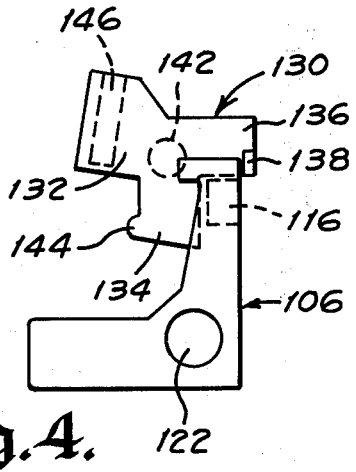
FIG. 4 is a side, elevational view looking at the locking arm and the inner lock in such a position that the inner lock prevents movement of the locking arm, and with the prevention of the movement of the locking arm, the locking pawl is restricted in movement.

The main body of inner lock 130, see FIGS. 4 and 5, is on the other side of the locking arm 106. The rotation of the inner lock 130 is restricted by the pawl lug 116. In FIGS. 4 and 5, that taut line movement of the inner lock 130 is restricted to the movement allowed by the pawl lug 116 on the locking arm 106.

The inner lock 130 has a recess or a cavity 146. The recess or cavity 146 is to receive a safety lock.

A summary to date shows that the U-shaped hook 26 is locked into position with the locking surface 80 bearing against the locking bearing surface 98 of the locking pawl 82, see FIGS. 1 and 3. The locking pawl 82 is locked into position as the locking end 102 of the locking pawl is prevented from movement by the locking ledge 114 of the locking arm 106.If the locking arm 106 were free to move so that the locking ledge 114 could rotate away from the locking end 102 of the locking pawl 82, then the locking pawl 82 would be free to rotate so as to remove the locking bearing surface 98 from the vicinity of the locking surface 80, thereby allowing the U-shaped hook 26 to rotate to free the line 78. To the present, this is not possible because of the locking provisions of the locking arm 106 and the locking pawl 82. To assure the restriction of movement of the locking arm 106 or to assure that the locking arm 106 cannot move, then there is provided the inner lock 130. The locking lug 130 bears against the locking arm 106 so as to prevent rotation of the locking arm 106. There is provided a definite and positive locking means to prevent rotation of the locking arm 106 and the locking pawl 82 and the U-shaped hook 26.

With the U-shaped hook 26 locked in position, there must be a means to release the U-shaped hook 26 so that it can rotate to allow the line 78 to escape from the hook 26.

In FIG. 1, there is illustrated a fluid actuated cylinder 150 having a ram 152. There are two fluid lines 154 and 156 connecting with an appropriate valve 158. The valve 158, by means of appropriate fluid lines 160 and 162, connects with a motor and complement reservoir combination 164.

To release the locking mechanism so that the U-shaped hook 26 can rotate to release the line 78, the fluid actuated cylinder 150 can be actuated to extend the plunger 152 to contact the bearing ledge 144, see FIG. 1.

In FIG. 4, it is seen that the locking lug 138 prevents the rotation of the locking arm 106. In that position, the ram 152 has not been extended, or has been extended only a slight distance.

With the extension of the ram 152 so as to contact the bearing ledge 144 and to rotate the inner lock 130, see FIG. 5, in a counterclockwise direction, the locking lug 138 is removed from a locking position with respect to the locking arm 106. Then, the locking arm 106 is free to rotate in a clockwise direction so that the locking ledge 114 moves away from the locking end 102 of the locking pawl 82. With respect to FIG. 3, the locking pawl 82 is then in a position to rotate in a counterclockwise manner so that the locking bearing surface 98 is free to rotate away from the locking surface 80 of the U-shaped hook 26. The pull on the line 78 in the U-shaped hook 26 is such as to rotate the U-shaped hook, see FIGS. 7, 8, and 9, in a counterclockwise direction, so that the line 78 escapes from the U-shaped hook 26 and the ship or boat is free to move away from the dock.

In FIGS. 1, 7, 8, and 9, it is seen that on the outer surface of the U-shaped hook 26 and at about the junction of the hook portion 28 and the main body portion 30, there is a bumper surface 170.

In the sides 22 and 24, there is a slot or recess 172. There is positioned in the slot or recess 172 and inner metal plate 174, a resilient, flexible means 176, and an outer metal plate 178.

The metal plates 174 and 178 and the flexible, resilient means 176 extend across the lower part of the releasable hook and extend from one side 22 to the other side 24. The metal plates 174 and 178 and the resilient means 176 are held in position by means of bolts 180 projecting through passageways in the plates in the resilient means and into tapped passageways 182 in the sides 22 and 24.

With the line 78 pulling on the U-shaped hook 26 and the release of the locking mechanism for restricting the movements of the U-shaped hook 26, the line 78 will pull the U-shaped hook 26 so that the bumper surface 170 rotates, in a counterclockwise manner, so as to strike the metal plate 178. The resilient cushion means 176 absorbs and distributes some of the shock of the U-shaped hook 26 hitting the metal plate 178. The resilient means 176 may be of many different compositions. One composition may be a mixture of tetrafluoroethylene and a polyester resin. Another composition for 176 may be a special synthetic rubber or special natural rubber which has been formulated to withstand the shock of being hit by the metal plate 178.

Figure 6:
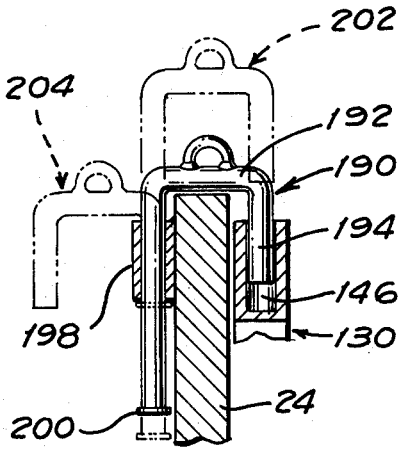
FIG. 6 is a fragmentary, lateral, cross-sectional view of a safety lock to restrict movement of the inner lock and thereby to restrict movement of the locking arm and the locking pawl and the rotation of the release hook.

There is a safety catch for preventing rotation of the U-shaped hook 26. This safety catch is such as to lock the inner lock 130 in movement and by restricting the movement of the inner lock 130, the locking arm 106 locks the locking pawl 82 and the U-shaped hook 26 cannot rotate to release the line 78. In FIG. 6, there is illustrated a safety hook 190 having a base 192, a short leg 194, and a long leg 196. The short leg 194 can be positioned in the recess 146 of the inner lock 130. There is welded on to the outer surface of the side 24 a sleeve 198. At the lower end of the long leg 198, there is a circular ledge or washer 200.

In FIG. 6, with the safety latch shown in dotted line, it is seen that the inner lock 130 is locked in position and cannot move and thereby there is locked in position the locking arm 106, the locking pawl 82, and the U-shaped hook 26 so that the U-shaped hook 26 is not free to move and to rotate.

In FIG. 6, it is seen that in the phantom line, reference numeral 202, the safety catch 190 has been pulled out of the recess 146 of the inner lock 130 so that the inner lock 130 is free to move thereby making it possible for the locking arm 106 to move and to rotate and thereby making it possible for the locking pawl 82 to move and to rotate with the result that the U-shaped hook 26 is free to move and to rotate.

Also, in FIG. 6, it is seen that the latch 190 has been moved and rotated to the position identified by reference numeral 204. The inner lock 130 is free to rotate and likewise, the locking arm 106 is free to rotate and the locking pawl 82 is free to rotate and the U-shaped hook 26 is free to rotate so as to release the line 78.

Some of the requirements to secure a patent are that the invention must be new, useful and unobvious. 35 U.S.C. 101 states:

"Inventions patentable. Whoever invents or discovers any new and useful process, machine, manufacture, or composition of matter, or any new and useful improvement thereof, may obtain a patent therefor, subject to the conditions and requirements of this title."

I consider that the invention is new in that I do not know of another release hook or of another apparatus having the positive locking mechanism and also the positive release mechanism disclosed and claimed by this invention and for this type of release hook.

I consider the invention to be useful as it is for releasable hooks which can be used for tieing to a dock a ship or boat until it is appropriate to trip the release hook to allow the ship and boat to move away from the dock. 35 U.S.C. 103 states:

"Conditions for patentability; non-obvious subject matter. A patent may not be obtained though the invention is not identically disclosed or described as set forth in section 102 of this title, if the differences between the subject matter sought to be patented and the prior art are such that the subject matter as a whole would have been obvious at the time the invention was made to a person having ordinary skill in the art to which said subject matter pertains. Patentability shall not be negatived by the matter in which the invention was made."

I consider this invention to be unobvious as I do not known of any apparatus or mechanism employing or describing such a positive locking mechanism for the release hook and also such a positive release mechanism for the release hook.

For the foregoing reasons, I consider that the invention meets the statutory requirements for a patent.

In the preparation of this patent application, there was called to my attention the following patents:

| | |
|---|---|
| 1,101,113 | 2,896,995 |
| 1,242,809 | 3,054,635 |
| 1,377,159 | 3,405,965 |
| 2,359,275 | 3,436,795 |
| 2,858,161 | 3,610,674 |
| 2,864,644 | |

Although the foregoing invention has been described with respect to a release hook for a line running to a ship or boat, it is to be realized that this release hook may be used in other situations, not, necessarily, with respect to a ship or a boat but with respect to a tieing mechanism for definitely positioning an object.

From the foregoing and having presented my invention, what I claim is:

1. A releasable hook comprising:

a. a frame;
b. a U-shaped hook having a hook means and a main body portion;
c. a first shaft on said frame;
d. said U-shaped hook being rotatably positioned on said first shaft;
e. said hook having a locking surface;
f. a locking pawl;
g. a second shaft on said frame;
h. said locking pawl being rotatably positioned on said second shaft;
i. said locking pawl having a locking bearing surface for engaging said locking surface of said hook to restrict movement of said U-shaped hook;
j. said locking bearing surface upon rotating away from said U-shaped hook releasing said U-shaped hook to rotate;
k. a control means for controlling the movement of said locking pawl;
l. said frame comprising a bumper juxtapositioned to said U-shaped hook;
m. said U-shaped hook having a bumper surface; and,
n. said U-shaped hook being capable of rotating around said first shaft with said bumper surface contacting said bumper.

2. A releasable hook according to claim 1, and comprising:

a. said bumper comprising a metal striking plate and a resilient means in back of said metal striking plate to absorb and distribute the force of said hook striking said bumper.

3. A releasable hook comprising:

a. a frame;
b. a U-shaped hook having a hook means and a main body portion;
c. a first shaft on said frame;
d. said U-shaped hook being rotatably positioned on said first shaft;
e. said hook having a locking surface;
f. a locking pawl;
g. a second shaft on said frame;
h. said locking pawl being rotatably positioned on said second shaft;
i. said locking pawl having a locking bearing surface for engaging said locking surface of said hook to restrict movement of said U-shaped hook;
j. said locking bearing surface upon rotating away from said U-shaped hook releasing said U-shaped hook to rotate;
k. a control means for controlling the movement of said locking pawl;
l. said locking pawl having a stop cam;
m. a pawl stop mounted on said frame and juxtapositioned to said locking pawl; and,
n. with said locking bearing surface rotating away from said U-shaped hook said stop cam being capable of striking said pawl stop and being limited in its movement.

4. A releasable hook according to claim 3, and comprising:

a. said frame comprising a bumper juxtapositioned to said U-shaped hook;
b. said U-shaped hook having a bumper surface; and,
c. said U-shaped hook being capable of rotating around said first shaft with said bumper surface contacting said bumper.

5. A releasable hook according to claim 4, and comprising:

a. said bumper comprising a metal striking plate and a resilient means in back of said metal striking plate to absorb and distribute the force of said hook striking said bumper.

6. A releasable hook comprising:

a. a frame;
b. a U-shaped hook having a hook means and a main body portion;
c. a first shaft on said frame;
d. said U-shaped hook being rotatably positioned on said first shaft;
e. said hook having a locking surface;
f. a locking pawl;
g. a second shaft on said frame;
h. said locking pawl being rotatably positioned on said second shaft;
i. said locking pawl having a locking bearing surface for engaging said locking surface of said hook to restrict movement of said U-shaped hook;
j. said locking bearing surface upon rotating away from said U-shaped hook releasing said U-shaped hook to rotate;

k. a control means for controlling the movement of said locking pawl;
m. a release hook stop mounted on said frame and juxtapositioned to said main body portion; and,
n. said release hook stop limiting the movement of said U-shaped hook into said frame.

7. A releasable hook according to claim 6, and comprising:
a. said release hook stop having an adjustable means for limiting the movement of said U-shaped hook.

8. A releasable hook according to claim 7, and comprising:
a. said frame comprising a bumper juxtapositioned to said U-shaped hook;
b. said U-shaped hook having a bumper surface;
c. said U-shaped hook being capable of rotating around said first shaft with said bumper surface contacting said bumper;
d. said bumper comprising a metal striking plate and a resilient means in back of said metal striking plate to absorb and distribute the force of said hook striking said bumper;
e. said locking pawl having a stop cam;
f. a pawl stop mounted on said frame and juxtapositioned to said locking pawl; and,
g. with said locking bearing surface rotating away from said U-shaped hook said stop cam being capable of striking said pawl stop and being limited in its movement.

9. A releasable hook comprising:
a. a frame;
b. a U-shaped hook having a hook means and a main body portion;
c. a first shaft on said frame;
d. said U-shaped hook being rotatably positioned on said first shaft;
e. said hook having a locking surface;
f. a locking pawl;
g. a second shaft on said frame;
h. said locking pawl being rotatably positioned on said second shaft;
i. said locking pawl having a locking bearing surface for engaging said locking surface of said hook to restrict movement of said U-shaped hook;
j. said locking bearing surface upon rotating away from said U-shaped hook releasing said U-shaped hook to rotate;
k. a control means for controlling the movement of said locking pawl;
l. said control means comprising a locking arm mounted on said frame;
m. said locking arm having a locking ledge;
n. said locking pawl having a pawl bearing surface;
o. said locking arm and said locking pawl capable of being moved with respect to each other so that said locking ledge and said pawl bearing surface are in a locking relationship to each other; and,
p. said control means being capable of moving said locking arm away from said locking pawl to allow said locking pawl to rotate and to release said U-shaped releasable hook for rotational movement.

10. A releasable hook according to claim 9, and comprising:
a. said control means comprising an inner lock;
b. said inner lock being mounted on said frame;
c. said inner lock having a locking lug;
d. said locking lug being positioned adjacent to said locking arm;
e. in locking position said locking lug being juxapositioned to said locking arm to prevent rotation of said locking arm and to prevent rotation of said U-shaped hook; and,
f. said control means being capable of moving said locking lug away from said locking arm and to allow said locking arm to move away from said locking pawl to allow said locking pawl to rotate and to release said U-shaped releasable hook for rotational movement.

11. A releasable hook according to claim 10, and comprising:
a. a third shaft mounted on said frame;
b. said locking arm being mounted on said third shaft;
c. a fourth shaft mounted on said frame;
d. said inner lock being mounted on said fourth shaft; and,
e. said control means comprising a ram for rotating said locking lug away from locking arm to allow said locking ledge to rotate away from said locking pawl to allow said locking bearing surface to rotate awayfrom U-shaped hook to release said U-shaped hook for rotational movement.

12. A releasable hook according to claim 11, and comprising:
a. said frame comprising a bumper juxtapositioned to said U-shaped hook;
b. said U-shaped hook having a bumper surface; and,
c. said U-shaped hook being capable for rotating around said first shaft with said bumper surface contacting said bumper.

13. A releasable hook according to claim 12, and comprising:
a. said bumper comprising a metal striking plate and a resilient means in back of said metal striking plate to absorb and distribute the force of said hook striking said bumper.

14. A releasable hook according to claim 11, and comprising:
a. said locking pawl having a stop cam;
b. a pawl stop mounted on said frame and juxtapositioned to said locking pawl; and,
c. with said locking bearing surface rotating away from said U-shaped hook said stop cam being capable of striking said pawl stop and being limited in its movement.

15. A releasable hook according to claim 14 and comprising:
a. said frame comprising a bumper juxtapositioned to said U-shaped hook;
b. said U-shaped hook having a bumper surface; and,
c. said U-shaped hook being capable of rotating around said first shaft with said bumper surface contacting said bumper.

16. A releasable hook according to claim 15, and comprising:
a. said bumper comprising a metal striking plate and a resilient means in back of said metal striking plate to absorb and distribute the force of said hook striking said bumper.

17. A releasable hook according to claim 11, and comprising:
a. a release hook stop mounted on said frame and juxtapositioned to said main body portion; and,
b. said release hook stop limiting the movement of said U-shaped hook into said frame.

18. A releasable hook according to claim 17, and comprising:

a. said release hook stop having an adjustable means for limiting the movement of said U-shaped hook.

19. A releasable hook according to claim 18, and comprising:

a. said frame comprising a bumper juxtapositioned to said U-shaped hook;

b. said U-shaped hook having a bumper surface;

c. said U-shaped hook being capable of rotating around said first shaft with said bumper surface contacting said bumper;

d. said bumper comprising a metal striking plate and a resilient means in back of said metal striking plate to absorb and distribute the force of said hook striking said bumper;

e. said locking pawl having a stop cam;

f. a pawl stop mounted on said frame and juxtapositioned to said locking pawl; and, g. with said locking bearing surface rotating away from said U-shaped hook said stop cam being capable for striking said pawl stop and being limited in its movement.

* * * * *